US005735784A

United States Patent [19]

Ratzel

[11] Patent Number: 5,735,784

[45] Date of Patent: Apr. 7, 1998

[54] LOADING ASSEMBLY FOR A CUSHIONING CONVERSION MACHINE

[75] Inventor: Richard O. Ratzel, Westlake, Ohio

[73] Assignee: Ranpak Corp., Concord Township, Ohio

[21] Appl. No.: 478,008

[22] Filed: Jun. 7, 1995

[51] Int. Cl.[6] ..... B31B 1/00

[52] U.S. Cl. ..... 493/29; 493/34; 493/464; 493/967

[58] Field of Search ..... 271/273; 493/464, 493/967, 8, 9, 10, 17, 23, 24, 29, 34, 417, 436, 438, 434, 435, 439, 442, 443, 446, 462

[56] References Cited

U.S. PATENT DOCUMENTS

| | | | |
|---|---|---|---|
| 412,289 | 10/1889 | O'Leary . | |
| 632,781 | 9/1899 | Dela Mar . | |
| 2,610,134 | 9/1952 | Hoblick . | |
| 2,632,641 | 3/1953 | Rice . | |
| 3,241,665 | 3/1966 | Erk . | |
| 3,416,790 | 12/1968 | Davis . | |
| 3,627,125 | 12/1971 | Sugino . | |
| 3,840,224 | 10/1974 | Zawiski . | |
| 3,907,188 | 9/1975 | Peterson . | |
| 4,026,198 | 5/1977 | Ottaviano . | |
| 4,147,287 | 4/1979 | Reba . | |
| 4,367,947 | 1/1983 | Arter . | |
| 4,415,398 | 11/1983 | Ottaviano | 156/470 |
| 4,421,501 | 12/1983 | Scheffer | 493/439 |
| 4,630,815 | 12/1986 | Peterson | 271/273 |
| 4,787,546 | 11/1988 | Bradbury . | |
| 4,810,239 | 3/1989 | Moss | 493/23 |
| 4,875,670 | 10/1989 | Peterson | 271/273 |
| 4,958,829 | 9/1990 | Ward | 271/273 |
| 5,011,129 | 4/1991 | Holbrook | 271/273 |
| 5,044,624 | 9/1991 | Haus | 271/274 |
| 5,123,889 | 6/1992 | Armington et al. . | |
| 5,417,416 | 5/1995 | Marmin | 271/273 |
| 5,490,666 | 2/1996 | Albert | 270/5 |
| 5,564,987 | 10/1996 | Heiler | 271/273 |

FOREIGN PATENT DOCUMENTS

| | | |
|---|---|---|
| 2073712 | 10/1981 | United Kingdom . |
| 2097766 | 11/1982 | United Kingdom . |

*Primary Examiner*—Joseph J. Hail, III
*Assistant Examiner*—Christopher W. Day
*Attorney, Agent, or Firm*—Renner, Otto, Boisselle & Sklar, P.L.L.

[57] ABSTRACT

A novel loading assembly for a cushioning conversion machine that eliminates the need to manually thread the stock material through the former of the machine. The loading assembly is disposed at one end of the machine and feeds the stock material through the former to the machine's feed assembly. Hence, a cushioning conversion machine and method for converting a stock material into a cushioning product comprises a former assembly which forms the stock material into a strip of cushioning; a downstream feed assembly located at a downstream end of the former assembly which feeds the strip of cushioning passing therethrough; a loader feed assembly located at an upstream end of the former assembly, the loader feed assembly which, when engaged, feeds the stock material through the former assembly to the feed assembly; and a loader operator assembly for selectively engaging and disengaging the loading assembly. The loader operator assembly includes a lever movable between a non-load and load position, and a position detect device which, when the lever is in its load position, effects energization of the upstream feed assembly. The loader feed assembly includes opposed rollers relatively movable towards and away from one another, and the loader operator moves the opposed rollers towards and away from one another between engaged and disengaged positions. A crank is provided for rotating at least one of the opposed rollers, the crank being connected to a shaft on which said one roller is mounted for rotation with the shaft.

24 Claims, 4 Drawing Sheets

LOADING ASSEMBLY FOR A CUSHIONING CONVERSION MACHINE

FIELD OF THE INVENTION

The invention herein described relates generally to a cushioning conversion machine and, more particularly, to a loading assembly and method loading stock material in a cushioning conversion machine.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planer's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and renewable; making it an environmentally responsible choice for conscientious companies.

While paper in sheet form could possibly be used as a protective packaging material, it is usually preferable to convert the sheets of paper into a relatively low density pad-like cushioning dunnage product. This conversion may be accomplished by a cushioning conversion machine, such as that disclosed in commonly assigned U.S. Pat. No. 5,123,889. The therein disclosed cushioning conversion machine converts sheet-like stock material, such as paper in multi-ply form, into relatively low density pads. Specifically, the machine converts this stock material into a continuous unconnected strip having lateral pillow-like portions separated by a thin central band. This strip is coined along its central band to form a coined strip which is cut into sections, or pads, of a desired length. The stock material preferably consists of three superimposed webs or layers of biodegradable, recyclable and reusable thirty-pound Kraft paper rolled onto a hollow cylindrical tube. A thirty-inch wide roll of this paper, which is approximately 450 feet long, will weigh about 35 pounds and will provide cushioning equal to approximately four fifteen cubic foot bags of plastic foam peanuts while at the same time requiring less than one-thirtieth the storage space.

The cushioning conversion machine disclosed in the above-identified includes a stock supply assembly, a forming assembly, a feed gear assembly, a cutting assembly, and a post-cutting constraining assembly. The cushioning conversion machine further includes electrical circuitry which electrically controls the feed gear assembly and the cutting assembly.

In preparation for operation of the machine, the machine is loaded with stock material. Stock material, in particular multi-ply (usually three ply) kraft paper in roll form, is placed on a roll holder or cart for feeding into the machine. The stock material is threaded through the forming assembly, typically by folding the leading portion of the stock material in a triangular-like fashion and manually pushing this leading portion through the forming assembly (e.g., a forming frame and a converging chute) so that the "point" of the triangle is positioned between the gears of the gear assembly. During the threading procedure, a top cover of the machine frame is pivoted about a hinge or otherwise opened to allow access to the forming assembly for loading the paper into the machine.

Sometimes, the conversion machine is mounted such that the top cover is not readily accessible. Under these circumstances the loading operation described above may be difficult as access to the forming assembly is limited. Therefore, it would be advantageous to be able to load the machine without having access to the top cover such that the stock material can be loaded without having to manually thread the stock material through the former.

SUMMARY OF THE INVENTION

The present invention provides a novel loading assembly for a cushioning conversion machine that eliminates the need to manually thread the stock material through the former of the machine. The loading assembly is disposed at one end of the machine and feeds the stock material through the former to the machine's feed assembly.

According to one aspect of the invention, a cushioning conversion machine which converts a stock material into a cushioning product comprises a former assembly which forms the stock material into a strip of cushioning; a downstream feed assembly located at a downstream end of the former assembly which feeds the strip of cushioning passing therethrough; a loader feed assembly located at an upstream end of the former assembly, the loader feed assembly which, when engaged, feeds the stock material through the former assembly to the feed assembly; and a loader operator assembly for selectively engaging and disengaging the loading assembly.

In a preferred embodiment, the loader operator assembly includes a lever movable between a non-load and load position, and a position detect device which, when the lever is in its load position, effects energization of the downstream feed assembly. The loader feed assembly includes opposed rollers relatively movable towards and away from one another, and the loader operator includes a cam device connected to the lever for moving the opposed rollers towards and away from one another between engaged and disengaged positions. A crank is provided for rotating at least one of the opposed rollers, the crank being connected to a shaft on which the one roller is mounted for rotation with the shaft. Preferably, a plurality of pairs of opposed rollers are provided, and the lever is spring-biased so that the lever will return to the non-load position when released. In a preferred machine, the forming assembly causes inward rolling of the lateral sides of the stock material to form a strip of cushioning; the downstream feed assembly operates to connect the strip of cushioning along a central band intermediate pillow-like portions, whereby a strip of cushioning product is formed; and there is provided a cutting assembly which cuts the strip into cut sections.

According to another aspect of the invention, a method of converting a stock material into a cushioning product comprises the steps of: inserting a leading end portion of the stock material into an upstream end of the machine; moving at least one roller into driving engagement with the leading end portion of the stock material; rotating the one roller, thereby feeding the stock material through the machine; then moving the one roller out of driving engagement with the stock material; and then operating the machine to produce a cushioning product. The step of rotating may be done manually as by turning a crank to rotate the one roller until the stock material engages a feed assembly downstream of the one roller. A preferred method further comprises the preliminary steps of loading a supply of stock material, such as a multi-ply roll of paper, onto a holder therefor, passing the several plies of paper through a ply separator assembly, and then folding the leading end portion into an arrow-shape for feeding through the machine in the aforesaid manner.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
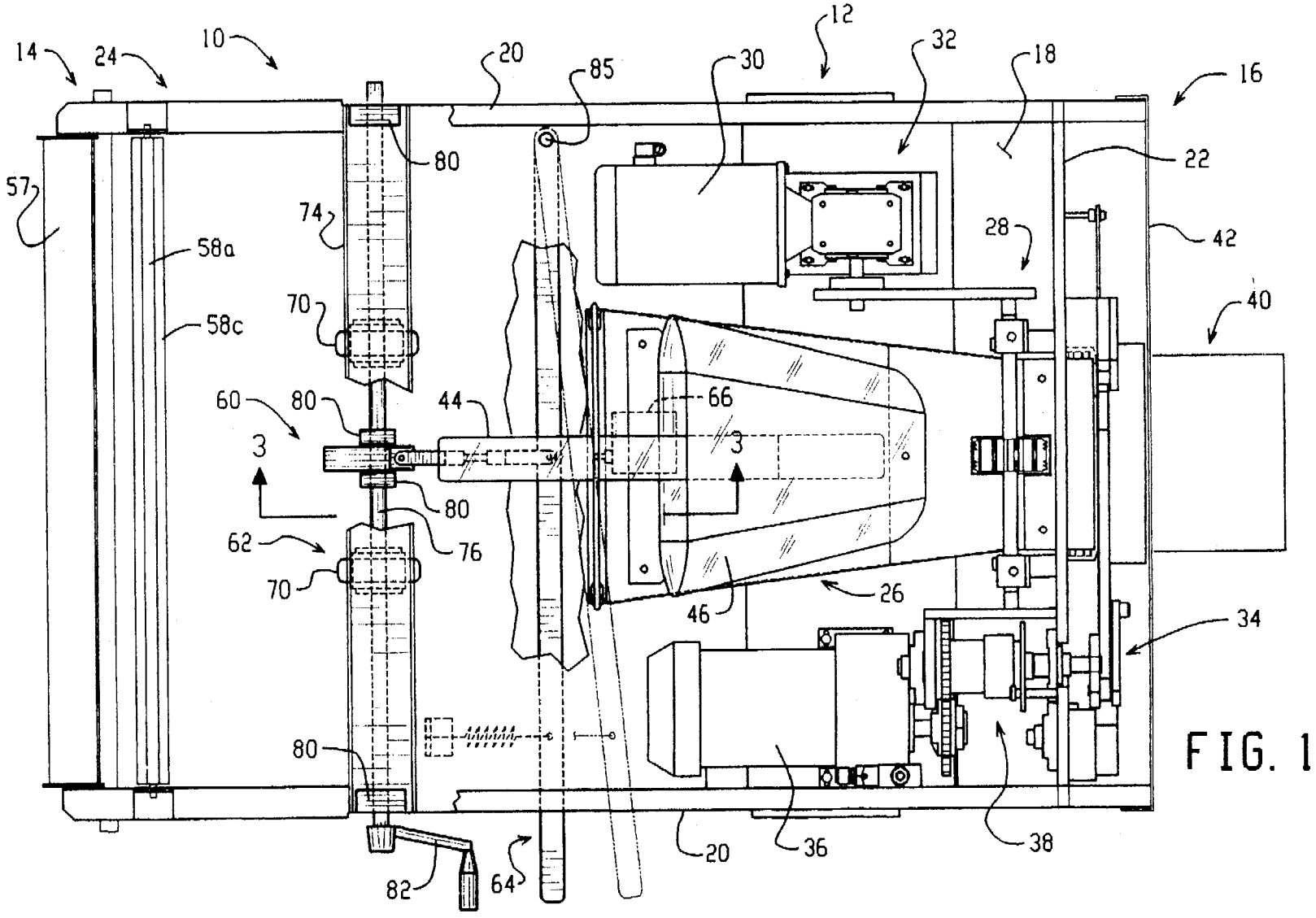
FIG. 1 is a top view of a cushioning conversion machine according to the present invention, the machine including an automatic loading assembly.

Referring now to the drawings in detail and initially to FIG. 1, a preferred embodiment of a cushioning conversion machine according to the present invention is designated generally by reference 10. The exemplary machine 10 depicted in FIG. 1 is a cushioning conversion machine which converts a sheet-like stock material, such as one or more layers of recyclable and reusable Kraft paper, into a dunnage product having lateral pillow-like portions separated by a thin central band. The dunnage product is used as an environmentally responsible protective packaging material typically used during shipping.

The machine 10 includes a housing, indicated generally at 12, having an upstream end 14 and a downstream end 16. The Kraft paper from which the packaging material is made is supplied from a source (not shown) near the upstream end 14 of the machine. The paper passes through the machine 10, and emerges at the downstream end 16. The housing includes base or bottom wall 18, side walls 20 and a downstream end plate which together form a frame structure. The housing also includes a top cover (not shown) for closing the top of the housing, as in well-known manner. A generally rectangular outlet opening in the end plate 22 allows the converted strip of cushioning product to pass therethrough. The machine 20 further includes a stock supply assembly 24, a forming assembly 26, a feeding/connecting assembly 28 powered by a feed motor 30 through a motion transfer assembly 32, and a cutting assembly 34 powers, by a cut motor 36 through a solenoid and clutch arrangement 38; all of which are mounted to and/or in the housing 12. A post-cutting constraining assembly 40 is located downstream of the cutting assembly 34 and is mounted on a removable closure 42 at the downstream end 16 of the machine 12.

In operation of the machine 10, stock supply material is supplied from the stock supply assembly 24 through an opening in the upstream end of the housing to the forming assembly 26 where it passes over a former 44 and into a converging shaping chute 46. The illustrated forming assembly 26, which is further described in copending U.S. patent application Ser. No. 08/337,929 causes an inward rolling of the lateral edges of the sheet-like stock material to form a continuous strip of cushioning having lateral pillow-like portions. Then the material is drawn through the nip of two cooperating and opposed gears of the feeding/connecting assembly 28. The feeding/connecting assembly 28 performs dual functions in the operation of the machine 10. One function is a "feeding" function, the gears pulling the stock material from a source and then through the forming assembly 26. The material is then discharged by the feeding/connecting assembly through the rectangular opening in the end plate 22. The second function performed by the feeding/connecting assembly 28 is a connecting function. Specifically, the feeding/connecting assembly 28 connects the continuous strip by two opposing gears coining and preferably perforating the formed stock material along a central band to form a connected strip. As the connected strip travels downstream from the feeding/connecting assembly 28 through the opening in the end plate 22, it passes through the cutting assembly 34 which cuts the strip into sections of a desired length. These cut sections then travel through the post-cutting constraining assembly 40, which includes a converging portion and rectangular tunnel portion. The coined strip then emerges from the post-cutting constraining assembly where an operator may remove the coined strip from the machine 10. Although the rotating feed elements are referred to as gears, this reference to gears is intended to encompass any other type of paired rotating elements between which the stock material may be engaged for continued passage therebetween.

Figure 2:
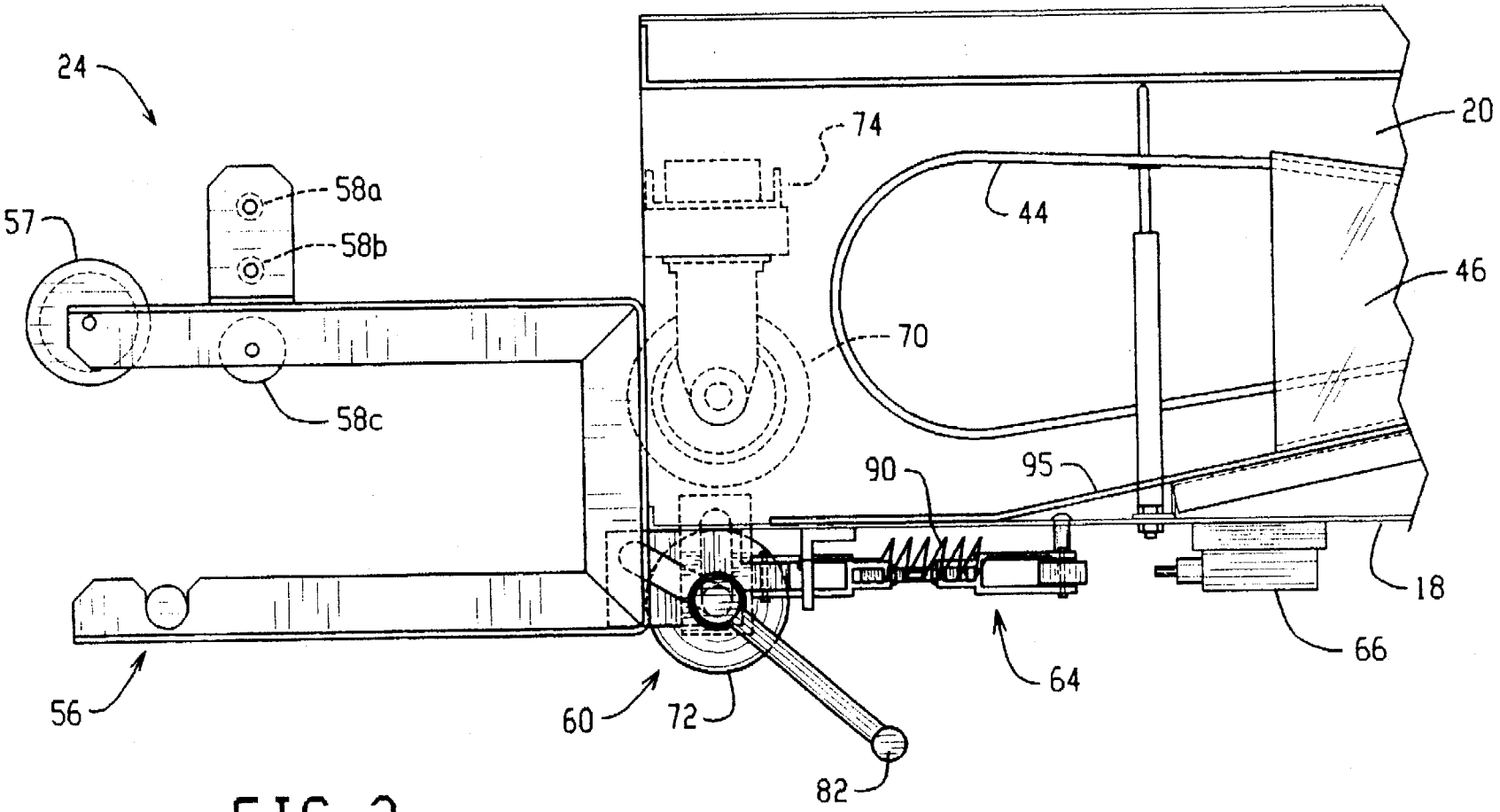
FIG. 2 is a side view of the machine shown in FIG. 1 showing the components of the loading assembly.

In preparation for operation of the machine, the stock supply assembly 24 is loaded with stock material. The stock supply assembly may include or have associated therewith a stock dispenser such as a stock roll holder 56 (FIG. 2) onto which a stock roll can be loaded and then supported for paying off stock material during operation of the machine. As will be appreciated, other forms of stock holders may be used. For example, the stock holder may be a cart onto which a roll of stock material may loaded and then the cart rolled into position at the back of the machine 10 for supplying stock material to the downstream components of the machine. As shown in FIG. 2, the stock roll holder is formed by the lower arms of C-shape brackets secured to the rear end of the housing 12. Also, in the illustrated embodiment, the stock material supply includes in known manner a constant feed roller 57 and separators 58*a–c*, the former providing a constant point of entry for the stock material regardless of the diameter of the stock roll and the latter serving to separate the plies or layers of stock material prior to passage to the forming assembly 26. Reference may be had to U.S. Pat. Nos. 4,026,198, 4,650,456, 4,750,896, 5,123,889 and 5,322,477 for further details of the illustrated stock material supply and stock roll holder, as well as for examples of alternative stock material supply arrangements.

Heretofore, the leading portion of the stock material coming from the separators was manually threaded through the forming assembly 26. This threading typically entailed folding the leading portion of the stock material in a triangular-like fashion and manually pushing this leading portion through the forming assembly (e.g., a forming frame and a converging chute) so that the "point" of the triangle was positioned between the gears of the feed/connecting assembly. Although effective, this task was somewhat tedious and generally there was a need to provide access to the interior of the machine to enable such manual threading.

The loading assembly 60 of the present invention replaces this "hand" threading, allowing the threading to be performed automatically by operating the loading assembly. As discussed further below, the loading assembly may in part be manually powered, but the threading operation is performed automatically.

The loading assembly 60 includes a loader feed 62 positioned near the upstream end of the housing 12, a loader operator 64 for selectively engaging and disengaging the loader feed between load and non-load positions, and a condition detect device 66 which activates the feed motor 30, thereby driving the gears of the feeding/connecting assembly 28, when the load position of the operator is detected.

Referring now additionally to FIG. 2, the loader feed 62 includes one or more upper rollers 70 and respective lower rollers 72. The upper rollers 70 are rotatably supported in clevises secured to a transverse frame member 74 spanning the width of the housing. As shown, the upper rollers 70 are equally laterally spaced from a centerline through the forming assembly which coincides with the centerline of the stock material path through the machine. The upper rollers 70 may form a part of the forming assembly as in the manner described in the concurrently filed commonly owned application of Michael J. Lencoski, Ser. No. 08/487,011 entitled "Cushioning Conversion Machine With Wheel Paper Former", or the upper rollers 70 and consequently the loader feed 62 may be in addition to the forming assembly. The said application of Lencoski is hereby incorporated herein by reference.

Figure 3:
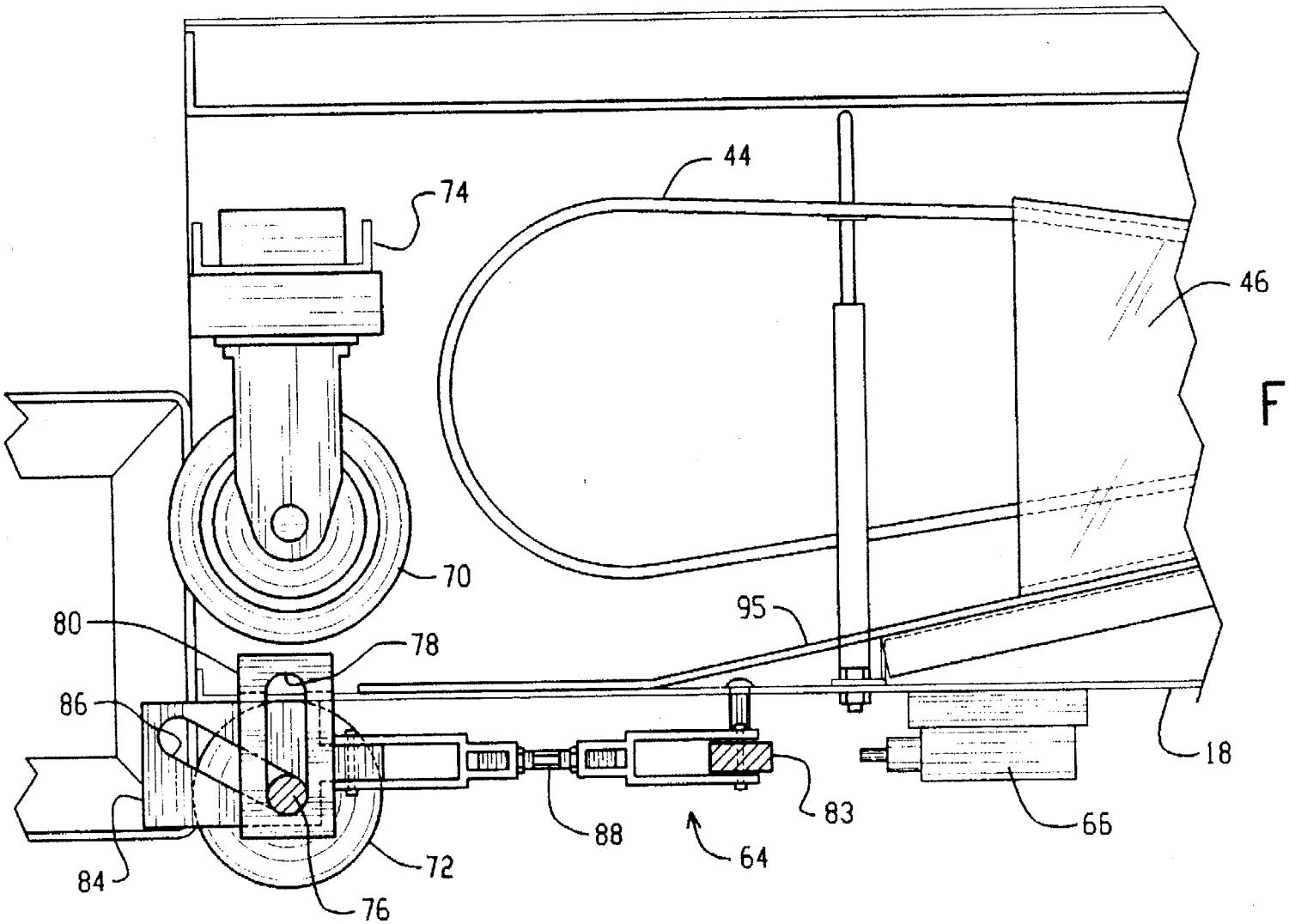
FIG. 3 is a side view of the loading assembly in the non-load position.

With additional reference to FIG. 3, the lower rollers 72 are keyed to a shaft 76 which is movable towards and away from the upper rollers as will be described in more detail below. Although two pairs of rollers are illustrated, one skilled in the art will realize that the upper and/or lower rollers may be replaced by one or more rollers, such as a single roll preferably having a width approximately equal the lateral spacing of the illustrated pairs of rollers. Preferably, one roller of each set of opposed rollers, such as the upper roller, preferably is made of rubber at its outer diameter while the other roller may have a knurled outer diameter surface.

The shaft 76 extends through and is guided by slots 78 in a plurality of guide blocks 80 secured to the housing. The slots 78 extend radially with respect to the common rotational axis of the upper rollers 70 and guide the shaft 76 for movement toward and away from the upper rollers 70. At one end of the shaft 76 there is provided a crank 82 for rotating the shaft.

The loader operator 64 includes a lift lever 83 pivoted at one end to the housing at 85 for movement between a non-load position and a load position. The lever 83 has a handle portion at its free end projecting beyond the housing for easy grasping. The lever is connected at the middle thereof to a cam block 84 by a turnbuckle-like linkage 88. The cam block 84 includes an inclined cam slot 86 through which the center of the shaft 76 extends. The cam block 84 is constrained with respect to the housing by suitable structure for movement in a direction perpendicular to the guide slots 78 in the guide blocks 80.

When the lift lever 83 is moved towards the downstream end 16 of the machine 10, the cam block 84 is shifted forwardly with the inclined cam slot 86, therein urging the shaft 76 upwardly. This moves the lower rollers 72 carried on the shaft 76 towards and into engagement with the upper rollers 70. In reverse manner, the lower rollers 72 are lowered away from the upper rollers 70 to a release or nonload position when the cam block 84 is shifted rearwardly by the lift lever. Preferably, the lever 83 is biased toward its unload position, as by a spring 90 connected between the lever 83 and a bracket on the bottom wall 18. As will be appreciated, the centrally located cam block 84 will allow the shaft 76 to rock for even application of pressure on the rollers when the shaft is raised.

As above indicated, the lever 83 moves between a non-load position, shown in FIG. 1 in solid, and a load position, shown in FIG. 1 in phantom. When the lever is in its loading position as further shown in FIG. 4, it engages the condition detect device 66 which in the illustrated embodiment is a switch that is closed when engaged by the lever 83. When the switch closes, the feed motor 30 is energized. The feed motor 30 drives the gears of the feeding/connecting assembly 28 as previously discussed. In the embodiment illustrated, the switch 66 is a plunger switch, although other types of switches or other devices may be used, such as a proximity switch.

Figure 4:
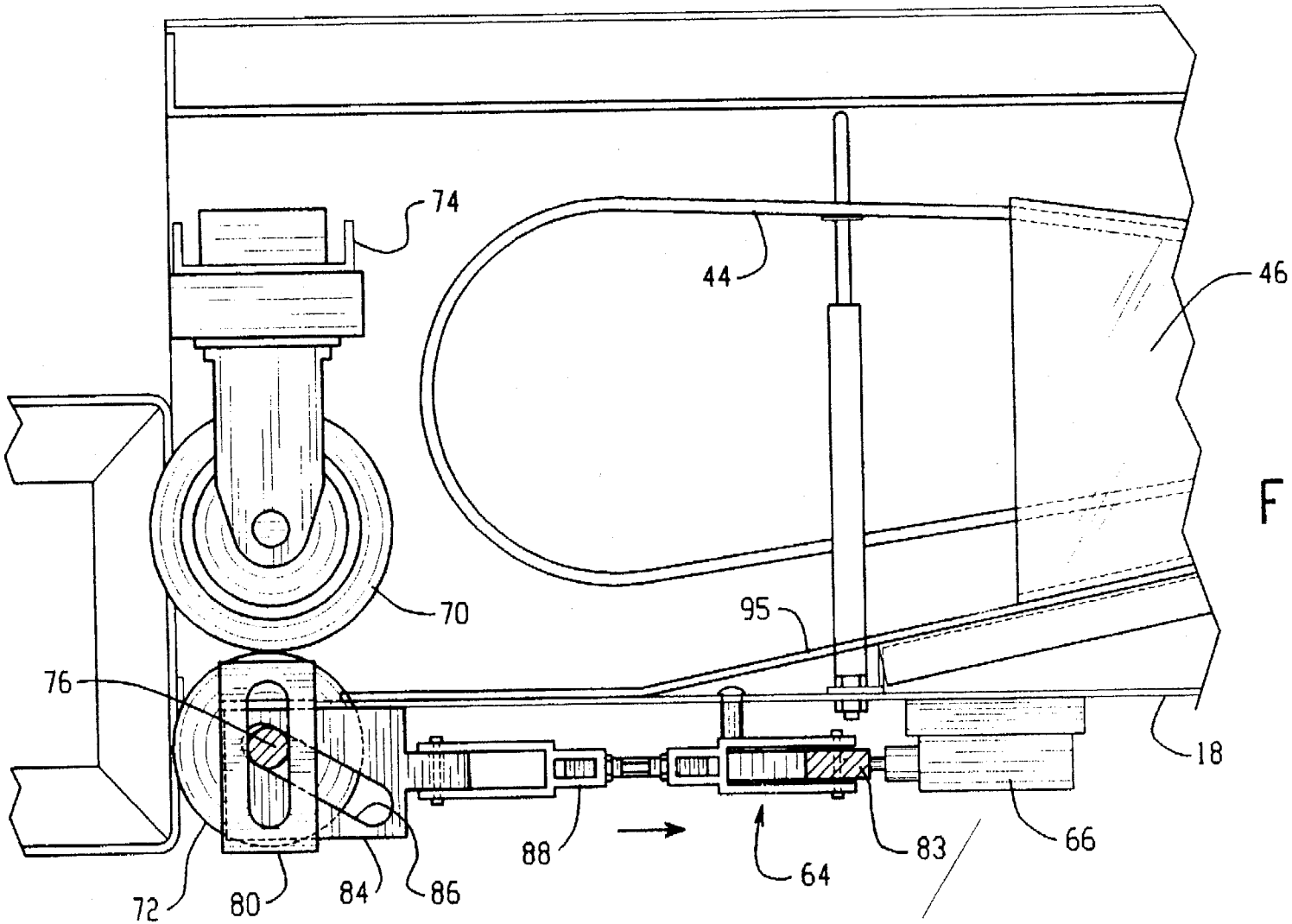
FIG. 4 is a side view of the loading assembly in the load position.

To load the machine 10 according to a preferred method of the invention, a supply of stock material, such as a multi-ply roll of Kraft paper, is loaded onto a holder therefor. The several plies of paper are then passed through the separator assembly 58, after which the leading ends of the plies or layers are brought back together and folded into an arrow-shape or triangular-like fashion. The leading portion of the stock material is then pushed through an opening in the upstream end 14 of the machine and between the opposed upper and lower rollers 70 and 72. This is done when the lower rollers 72 are in their non-load position spaced apart from the upper rollers 70, as illustrated in FIG. 3. With the leading portion of the stock material located between the upper and lower rollers, the lift lever 83 is moved towards the downstream end 16 of the machine thereby raising the lower rollers 72 towards and against the upper rollers 70, as best illustrated in FIG. 4. The stock material will then be pinched between the rollers. Also, the switch 66 will be engaged to operate the feed motor 30 which in turn rotates the feed/connecting gears.

While holding the lever 83 in the load position illustrated in FIG. 4, the crank 82 on the end of the shaft is turned to rotate the lower rollers 72. As the lower rollers 72 are rotated, the stock material is fed forwardly through the forming assembly 26. Preferably, a transition ramp 95 or rearward extension of the bottom of the chute 46 is provided to guide the stock material from the rollers to and into the wide end of the chute for passage through the chute to the feed/connecting gears. When the leading portion of the stock material engages the meshing teeth of the gears of the feeding/connecting assembly 28 and begins to be drawn through the machine by the gears, the lift lever 83 is released and returned to its non-load position either by the machine operator or under the action of the biasing spring 90. This lowers and thus disengages the lower rollers 72. Also, the switch 66 will be disengaged to deenergize the feed motor 30. The machine 10 is now ready for operation in well known manner to produce a cushioning product.

Although the invention has been shown and described with respect to an exemplary embodiment thereof, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A cushioning conversion machine which converts a stock material into a cushioning product comprising:

a stock supply assembly which supplies the stock material;

a former assembly which forms the stock material into a strip of cushioning;

a downstream feed assembly located at a downstream end of the former assembly which feeds the strip of cushioning passing therethrough; and a loading assembly which feeds the stock material through the former assembly during loading of the machine;

wherein the loading assembly includes a loader feed located at an upstream end of the former assembly movable between a load position whereat it feeds the stock material through the former assembly to the downstream feed assembly and a non-load position; and wherein the loading assembly also includes a loader operator coupled to the loader feed, which selectively moves the loader feed between the load position and the non-load position.

2. A cushioning conversion machine according to claim 1, wherein the loader operator includes a lever coupled to the loader feed to move the loader feed between the non-load and the load position, and wherein the loading assembly further includes a position detect device which, when the loader feed is in the load position, effects energization of the downstream feed assembly.

3. A cushioning conversion machine according to claim 2, wherein the loader feed includes opposed rollers relatively movable towards and away from one another, and the loader operator includes linkage connecting said lever to the loader feed for moving said opposed rollers towards and away from one another between an engaged position whereat the loader feed is in the load position and a disengaged position whereat the loader feed is in the non-load position.

4. A cushioning conversion machine according to claim 3, wherein the lever includes a handle for manually operating the loader operator.

5. A cushioning conversion machine according to claim 3, wherein the loader feed further includes a crank for rotating at least one of the opposed rollers.

6. A cushioning conversion machine according to claim 5, wherein the crank is connected to a shaft on which said one roller is mounted for rotation with the shaft.

7. A cushioning conversion machine according to claim 6, wherein said opposed rollers include a plurality of pairs of opposed rollers.

8. A cushioning conversion machine according to claim 2, wherein the lever is spring-biased to the non-load position so that the loader feed will return to the non-load position when the lever is released.

9. A cushioning conversion machine according to claim 2, wherein the loader feed includes opposed rollers relatively movable towards and away from one another, wherein at least one of the opposed rollers is mounted to a shaft for rotation therewith, and wherein the loader operator includes linkage connecting said lever to the shaft for moving said opposed rollers towards and away from one another between an engaged position whereat the loader feed is in the load position and a disengaged position whereat the loader feed is in the non-load position.

10. A cushioning conversion machine according to claim 9, wherein the lever includes a handle for manually rotating the shaft.

11. A cushioning conversion machine according to claim 1, wherein the former assembly causes inward rolling of the lateral sides of the stock material to form a strip of cushioning; and the downstream feed assembly operates to connect the strip of cushioning along a central band intermediate pillow-like portions, whereby a strip of cushioning product is formed; and wherein the machine further comprises a cutting assembly which cuts the strip into cut sections.

12. A cushioning conversion machine according to claim 1, wherein the loading assembly further includes a position detect device which activates the downstream feed assembly when the loader feed is in the load position.

13. A method of converting a stock material into a cushioning product comprising the steps of:

supplying the stock material;

inserting a leading end portion of the stock material into an upstream end of a cushioning conversion machine;

moving at least one roller into driving engagement with the leading end portion of the stock material;

rotating said one roller, thereby feeding the stock material through the machine to load the machine;

then moving said one roller out of driving engagement with the stock material; and then operating the machine to produce a cushioning product.

14. A method according to claim 13, wherein the step of rotating is done manually.

15. A method according to claim 14, wherein said one roller is manually rotated until the stock material engages a feed assembly downstream of said one roller.

16. A method as set forth in claim 13 wherein said step of supplying the stock material comprises supplying stock material that is biodegradable, recyclable and renewable.

17. A method as set forth in claim 16 wherein said step of supplying the stock material comprises supplying stock material that is paper.

18. A method as set forth in claim 17 wherein said step of supplying the stock material comprises supplying stock material that is multi-ply kraft paper.

19. A method as set forth in claim 18 wherein said step of supplying the stock material comprises supplying stock material that is in roll form.

20. A cushioning conversion machine for converting a stock material into a cushioning product, said machine comprising:

a stock supply assembly which supplies the stock material;

conversion assemblies which convert the stock material into a three-dimensional strip during normal operation of the machine; and a loading assembly which loads the stock material through the conversion assemblies prior to normal operation of the machine;

wherein the loading assembly includes a loader feed which is positioned upstream of the conversion assemblies and a loader operator which is operatively coupled to the loader feed to move it between a load position whereat it is driven to load the stock material through the conversion assemblies and a non-load position whereat it is idle during normal operation of the machine.

21. A cushioning conversion machine as set forth in claim 20 wherein the conversion assemblies include a forming assembly which forms the stock material and a feed assembly positioned downstream of the forming assembly which feeds the stock material through the forming assembly during normal operation of the machine and wherein the loading assembly includes a device which activates the feed assembly when the loader feed is in the load position.

22. A cushioning conversion machine as set forth in claim 20 wherein the loader feed includes a roller which rotates to load the stock material through the conversion assemblies when the loader feed is in the load position.

23. A cushioning conversion machine as set forth in claim 22 wherein the roller is mounted on a shaft for rotation therewith and wherein the loader feed includes a crank for manually rotating the shaft when the loader feed is in the load position.

24. A method of converting a stock material into a three-dimensional cushioning product, said method comprising the steps of:

supplying the stock material;

inserting a leading end portion of the stock material into an upstream end of a cushioning conversion machine including conversion assemblies which convert the stock material into a three-dimensional strip during normal operation of the machine and a loading assembly which loads the stock material through the conversion assemblies prior to normal operation of the machine;

moving the loading assembly into a load position whereat it may driven;

driving the loading assembly while it is in the load position to load the stock material through the conversion assemblies;

moving the loading assembly from the load position to a non-load position whereat it is idle;

activating the conversion assemblies for normal operation of the machine while the loading assembly is idle in the non-load position.

* * * * *